United States Patent [19]

D'Albaret et al.

[11] Patent Number: 4,714,906

[45] Date of Patent: Dec. 22, 1987

[54] DIELECTRIC FILTER WITH VARIABLE CENTRAL FREQUENCY

[75] Inventors: Bertrand D'Albaret, Cormeilles en Parisis; Antoine Colombani, Ville D'Avray, both of France

[73] Assignee: Compagnie D'electronique et de Piezo-electricite, Argenteuil, France

[21] Appl. No.: 737,161

[22] Filed: May 23, 1985

[30] Foreign Application Priority Data

May 30, 1984 [FR] France ..... 84 08498

[51] Int. Cl.[4] ..... H01P 1/20

[52] U.S. Cl. ..... 333/202; 333/235

[58] Field of Search ..... 333/202, 219, 222, 223, 333/235

[56] References Cited

U.S. PATENT DOCUMENTS

| | | | |
|---|---|---|---|
| 3,747,032 | 7/1973 | Hall et al. | 333/223 |
| 3,766,494 | 10/1973 | Anbe et al. | 333/235 X |
| 3,889,214 | 6/1975 | Petitjean et al. | 333/203 |
| 4,179,673 | 12/1979 | Nishikauo et al. | 333/202 X |
| 4,477,786 | 10/1984 | Tamura et al. | 333/207 |
| 4,568,895 | 2/1986 | Reed | 333/203 |

FOREIGN PATENT DOCUMENTS

| | | | |
|---|---|---|---|
| 2141880 | 1/1985 | United Kingdom | 333/202 |

OTHER PUBLICATIONS

Uwano, Tomoki, "Ceramic-Filled Resonator Cuts Cost of Radio Telephone Filters", *Electronics;* Jul. 14, 1983; pp. 129-131.

D'Albaret, Bertrand; "A New Generation of UHF Filters from 300 MHz to Some Ghz", Using Dielectric Resonaters.

*Primary Examiner*—Paul Gensler
*Assistant Examiner*—Benny Lee
*Attorney, Agent, or Firm*—Roland Plottel

[57] ABSTRACT

A dielectric filter with variable central frequency is provided comprising at least one dielectric resonator formed from a dielectric ceramic body covered with electrodes as well as electromagnetic input and output means for coupling the signal to and from the filter. According to the invention, the filter further comprises a variable capacity connected between the electrodes of the resonator, in a capacitive zone of said resonator, for continuously varying the central frequency of said filter.

9 Claims, 4 Drawing Figures

DIELECTRIC FILTER WITH VARIABLE CENTRAL FREQUENCY

BACKGROUND OF THE INVENTION

1. Field of the Invention

The present invention relates to a dielectric filter with variable central frequency comprising at least one dielectric resonator formed from a dielectric ceramic body covered with electrodes as well as signal input and output electromagnetic coupling means to and from the filter.

2. Description of the Prior Art

Ultra high frequency (UHF) filters are widely used today, for example in telecommunications for choosing a given frequency band width. In frequencies up to about 700 MHz, filters comprising piezoelectric resonators may be used. However, for the whole of the UHF band width, extending up to 3 GHz such filters are no longer appropriate and dielectric filters are then used which have similar performances to cavity filters but which are much less costly and space consuming. In addition, for some applications the pass band of piezoelectric filters is too narrow.

Dielectric filters of this type have been described in the French application No. 82 18236 filed on Oct. 23rd 1982 in the name of THOMSON-CSF. Such parallelepipedic type filters use compositions of the type $SnTiO_4$.

Using such parallelepipedic resonators, band pass filters may be formed by disposing a plurality of resonators side by side. Generally, it is preferable to use resonators of the quarter wave type because of their shorter length. The electrode metallizations of these resonators are respectively parallel to each other and perpendicular to the insulating substrate on which said substrates are fixed. Coupling between these resonators is provided by mutual inductance. The connection to the input and to the output of the filter may be provided either by soldering respectively the first and the last resonator directly to the electrode, or by means of a loop placed above the first and last resonators as an exciter and a collector respectively. In in order to obtain a filter having a given pass band, resonators are used having a natural and given frequency and said resonators are coupled depending on the coupling coefficients required by calculation of the filter, by carefully adjusting the distance between the resonators. When it is desired to form a multichannel filter using such resonators, a plurality of resonators are generally placed close to one another. The natural frequency of each resonator is then tuned to the different frequencies of the channels and it is sufficient to switch the input and the output of the filter to the desired resonator for selecting the corresponding channel. Such a solution however requires the use of as many resonators as there are channels, and per filter pole. This results in a filter of considerable size which becomes prohibitive when the number of channels desired is greater than two.

SUMMARY OF THE INVENTION

The invention overcomes this problem, using only a single resonator, or a single assembly of resonators coupled together depending on the quality of the desired filter, while allowing selection of a large number of channels.

The dielectric filter with variable central frequency of the invention comprises a variable capacity connected between the electrodes of the dielectric resonator, in a capacative zone of said resonator, for continuously varying the central frequency of said filter. It has been discovered that such filters allow displacement of the central frequency, with substantially constant pass band, over several times the value of this pass band, with a very low level loss.

In a preferred embodiment, the filter of the invention comprises a plurality of dielectric resonators disposed close to one another and cut off from each other electromagnetically by the air.

Preferably, each resonator is of the quarter wave type and is formed from a parallelepipedic bar having four large faces and two small faces metallized on its large faces facing each other and on one small face situated in the extension of said large faces. The resonators are preferably fixed to a support having a low loss factor, by one of their large non metallized faces. In the case of a plurality of resonators, the small metallized faces will be preferably situated on the same side as the large faces.

In the case of a resonator of the above mentioned quarter wave type, which behaves like an LC circuit whose self inductive part is situated close to the metallization of the small face and whose capacitive part is situated between the metallizations of the electrode of the two large faces, in the vicinity of the small non metallized face, the input and/or output of the signal will take place over a connection placed on a large face electrode at a point close to the small metallized face whereas the variable capacity will be connected between the ends of the electrodes placed on the large faces, close to the small non metallized face.

In a particularly advantageous embodiment of the invention, for obtaining a more compact filter, the variable capacity will be a variable capacity diode, controlled by a DC voltage generally disposed outside the filter.

BRIEF DESCRIPTION OF THE DRAWING

The invention will be better understood from the following non limitative examples with reference to the Figures which show.

DESCRIPTION OF THE PREFERRED EMBODIMENT

Figure 1:
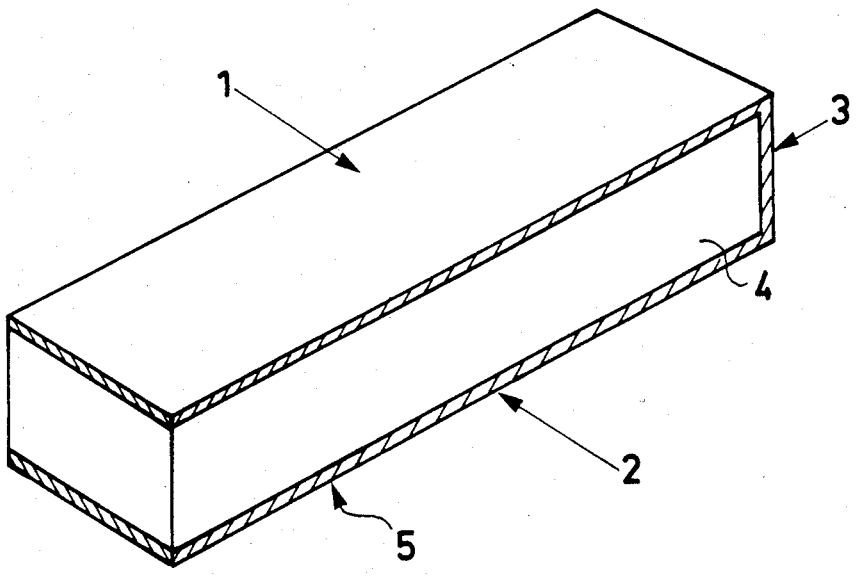
FIG 1 PRIOR ART
FIG. 1, a schematical view of a prior art quarter wave parallelepipedic resonator used in the invention.

In FIG. 1, can be seen a parallelepipedic dielectric ceramic resonator such as mentioned above and described in the above French patent application. It includes a dielectric ceramic parallelepipedic body 4 covered on two of its large opposite faces with metal layers 1 and 2 having an electrode function, and covered on one of its small faces by metal layer 3, and in the extension of the electrode of the large faces 1 and 2 opposite each other, an electrode metallization 3 is for the quarter wave circuit operation.

Figure 2:
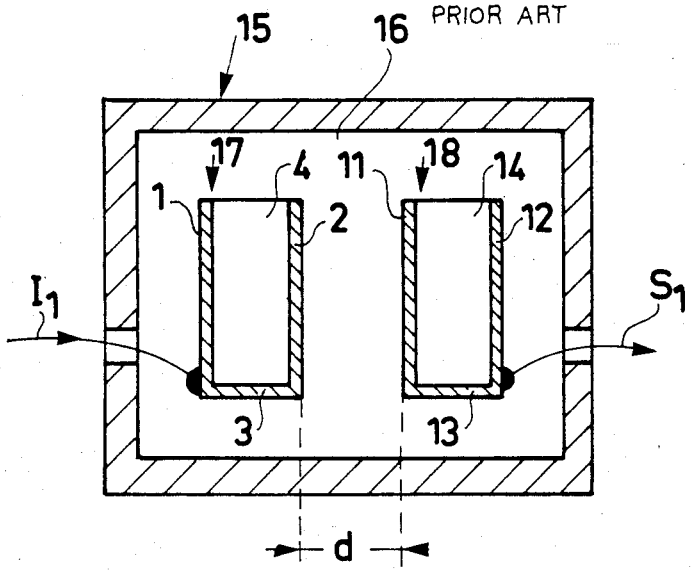
FIG 2 PRIOR ART
FIG. 2, a schematical view of the implementation of a two pole band pass filter using two resonators of the kind illustrated in FIG. 1.

FIG. 2 shows the arrangement of two resonators such as shown in FIG. 1, for forming a two pole band pass filter. It comprises a parallelepipedic case 15 having a rectangular central cavity 16 made from a material having low electromagnetic losses. Two resonators 17 and 18 are fixed to the bottom of case 15 in the way illustrated in this FIG. 2: the electrodes of the large faces respectively 1 and 2, 11 and 12 are disposed parallel to each other, 2 and 11 being spaced apart by a distance d, whereas the electrodes of the small faces 3 and 13 are placed in the extension of each other. All these electrodes are situated in planes perpendicular to the plane of cavity 16. The distance d between the resonators 17 and 18 determines the coupling coefficient between these two resonators, in a way known per se. The input of the signal takes place at I1 substantially at the intersection of electrodes 1 and 3, whereas the output of the signal takes place through S1 substantially at the intersection of electrodes 12 and 13.

Figure 3:
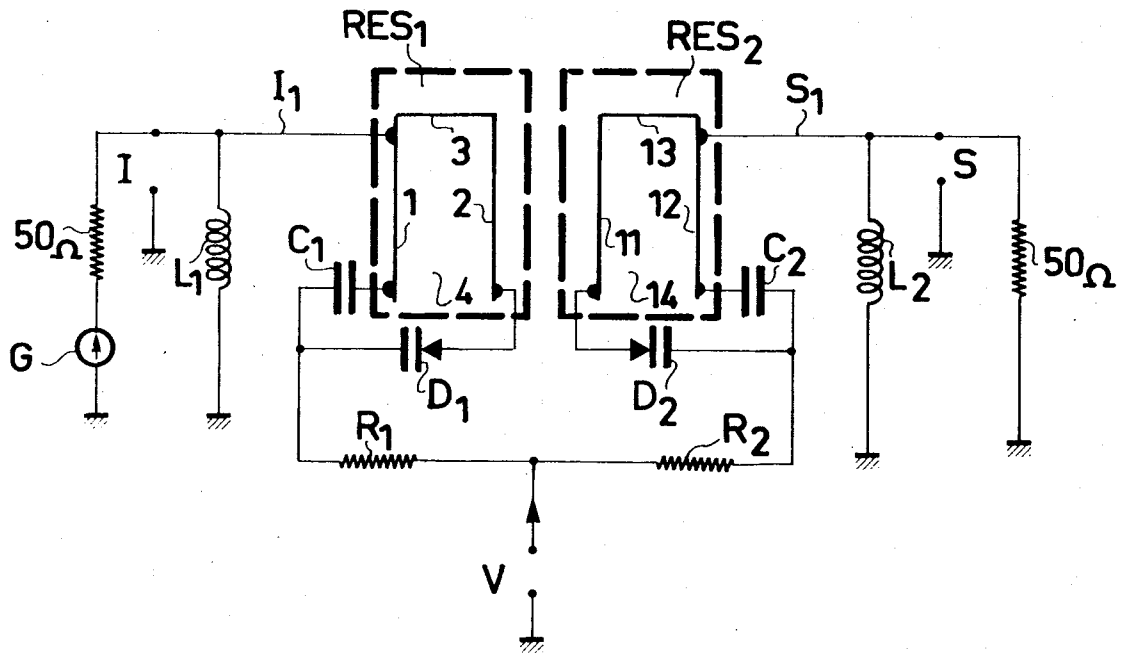
FIG. 3, a diagram showing the construction of a two pole band pass filter with variable central frequency in accordance with the invention.

FIG. 3 shows a diagram for constructing a two pole dielectric filter with a variable central frequency. It is formed from two resonators RES1 and RES2 disposed as shown in FIG. 2. The input of the signal to the filter takes place at I with an electromagnetic connection or coupling at I1 disposed as explained in FIG. 2. The output of the filter is provided at S with a connection or coupling S1 formed at the position indicated in FIG. 2. Close to the electrodes 1 and 2, on the same end as the small parallelepipedic non metallized face 4 there is connected to electrode 1 the first end of a capacitor C1 whose other end is connected both to a resistor R1 and to the cathode of a varicap diode D1 whose anode is connected to electrode 2, on the end of the small non metallized face side. The second end of resistor R1 is connected to a variable DC voltage source V. Similarly, the electrode 12 of resonator RES2 is connected to a first end of the capacitor C2 whose second end is connected on the one hand to the cathode of the varicap diode D2 whose other end is connected to electrode 11 close to its end on the small non metallized face side of the resonator and, on the other hand, to the resistor R2 whose other end is also connected to the variable DC voltage source V. In parallel between input I and ground C is placed a surge inductance L1, while a surge inductance L2 is also placed at the output. Of course, these inductances may have varying values depending on the application contemplated and do not strictly form part of the filter of the invention. They guarantee biasing of the variable capacity diode, because of the matched value of their resistance.

Figure 4:
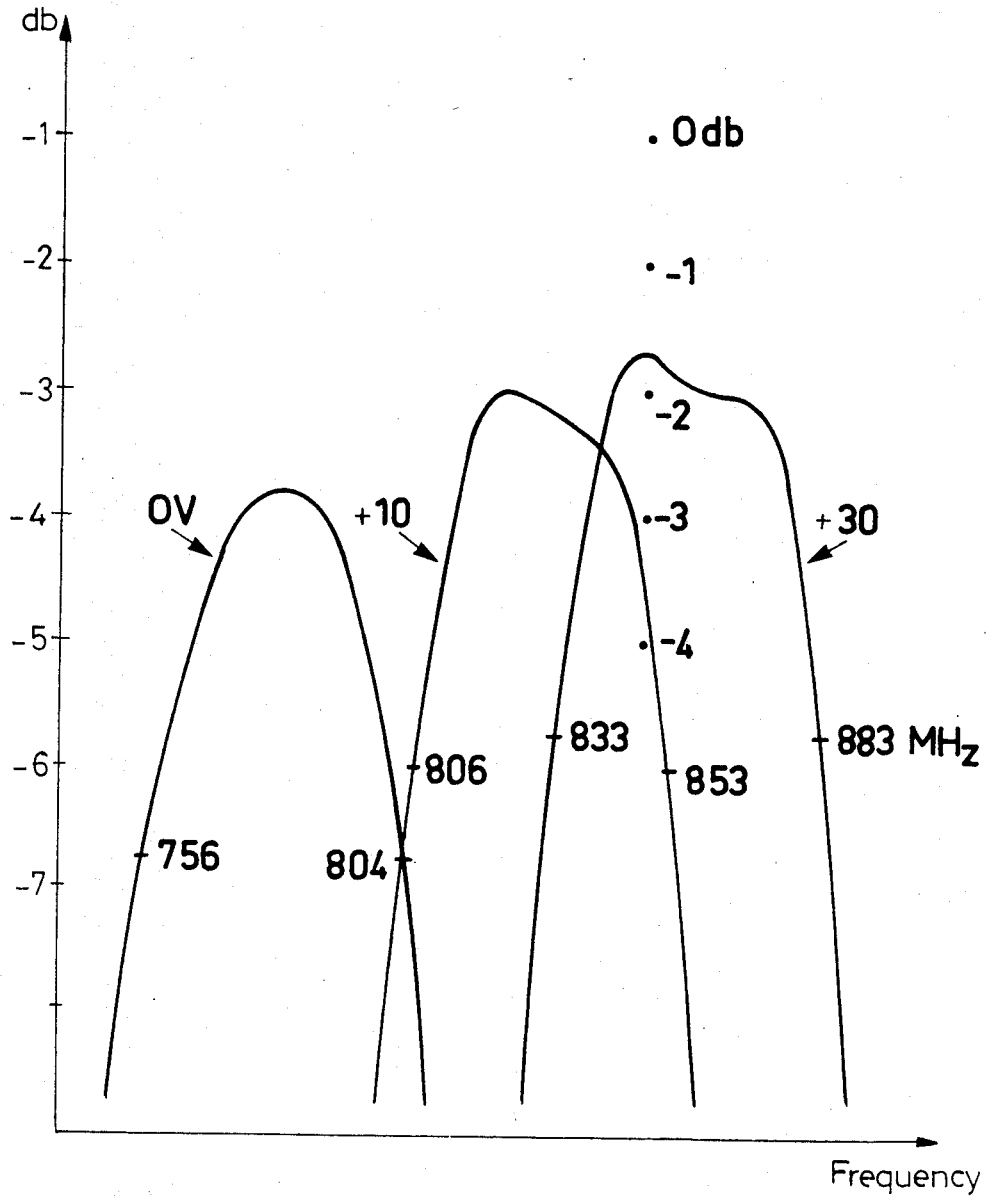
FIG. 4, a representation of the response curves of a filter such as shown in FIG. 3, with different supply voltages on the varicap diodes.

FIG. 4 shows the pass bands of the filter as a function of the voltage V applied to the varicap diodes for a filter having the parameters mentioned in the example below. The level OdB corresponds to the level of the input signal. At the output a signal can be seen whose attenuation is not greater than 3 dB. The pass bands of the fiter at −3 dB are mentioned numerically in the Figure, showing the excellent results obtained by means of the filter of the invention.

Of course, it is possible to form filters comprising a plurality of poles using a plurality of resonators. For this, each resonator is placed at a distance d from the adjacent resonator (see FIG. 2) depending on the desired coupling coefficient in a way which is well known to one skilled in the art. Each circuit, such as C1, D1 and R1 of each resonator such as RES1 is connected similarly to said resonator, the end of each resistor, such as R1, being connected directly to the voltage source V. Of course, the connections I1 and S1 are formed respectively on the first filter of the plurality and on the last filter thereof. In all cases, it will however be necessary to provide biasing means adapted for each variable capacity diode.

Example: the electric diagram is the one shown in FIG. 3 with the following numerical values:

R1, R2 = 10 kΩ

D1, D2 = variable capacity diode BA 149 (6 pF at 4 volts)

C1, C2 = 1.5 pF

V = DC voltage source, variable from 0 to 30 volts.

The resonators RES1, RES2 are laid out as shown in FIG. 2. They are bonded to an alumina substrate, at a distance d = 7 mm. Their dimensions are 16.5×7.5×7.5 (millimeters). The electrode metallizations are made from silver, have a thickness of about 50μ, and are deposited by means of a lacquer by silk screen printing.

The whole of the resonator is placed in an aluminium case, the distance between the faces of the resonators and the upper and lower walls of the case being of the order of 3 mm.

Throughout the description, the term electrode has been used for defining the conducting walls of the resonators.

We claim:

1. A tunable dielectric filter comprising a series of dielectric resonators including at least a first and a last resonator, each resonator comprising a ceramic body having at least six surfaces, two surfaces being opposed to one another and metallized to form a pair of opposed electrodes, and two other surfaces being opposed to one another and being free of electrodes, each of the electrodes having first and second ends, the first ends of each opposed electrodes being interconnected by a fifth surface of the ceramic body that is metallized with a coating that extends between the first ends of the two opposed electrodes, the second ends of the two opposed electrodes being connected by a sixth surface of the ceramic body that is free of any electrode to form a capacitive zone, input and output means for coupling a signal to and from the filter, the input means being connected to a first end of one of the opposed metallized electrodes of the first resonator of the series and the output means being connected to a first end of one of the opposed metallized electrodes of the last resonator of the series, and separate variable capacitance means being connected between the second ends of the two opposed electrodes of each resonator.

2. A tunable filter as in claim 1, in which each resonator is of the quarter-wave type and its ceramic body is a parallelepiped having two pairs of opposed large area surfaces and a pair of opposed small area surfaces, the two electrodes are on one of the pairs of opposed large area surfaces, the other pair of opposed large area surfaces being free of electrodes, and one of the two small area surfaces being metallized to form a third electrode which extends between the two electrodes on the large area surfaces.

3. The filter of claim 1 in which the dielectric resonators of the series are coupled together solely by mutual inductance and enclosed in a common cavity of material having low electromagnetic loss.

4. The filter of claim 3 in which each of the variable capacitance means is a voltage variable diode and voltage biasing means located outside the cavity supplies biasing voltages to the diodes.

5. The filter of claim 3 in which each ceramic body is supported in the cavity by one of the opposed large area surfaces free of electrodes.

6. The filter of claim 4 in which each resonator is of the quarter wavelength type and includes a ceramic body which is a rectangular parallelepiped having two pairs of opposed large area surfaces and a pair of opposed small area surfaces and in which the two opposed electrodes are in one pair of opposed large area surfaces and the other pair of large area surfaces is non-metallized and one of the two small area surfaces is metallized to form the third electrode.

7. The filter of claim 6 in which the dielectric resonators of the series are positioned in a common cavity and coupled together only by mutual inductance.

8. The filter of claim 7 in which a biasing means is located outside the cavity for biasing each variable capacitance diode.

9. A filter in accordance with claim 8 in which the biasing means is such that each diode is supplied by way of a separate resistor from a common d-c voltage source which is variable for tuning the center frequency of the pass-band of the filter.

* * * * *